US011581666B2

(12) United States Patent
Hashimoto et al.

(10) Patent No.: US 11,581,666 B2
(45) Date of Patent: Feb. 14, 2023

(54) SLEEVE AND SHIELD TERMINAL MANUFACTURING METHOD

(71) Applicant: Sumitomo Wiring Systems, Ltd., Yokkaichi (JP)

(72) Inventors: Norihito Hashimoto, Yokkaichi (JP); Keisuke Kanemura, Yokkaichi (JP); Motoki Kubota, Yokkaichi (JP); Liping Kang, Yokkaichi (JP); Shohei Mitsui, Yokkaichi (JP); Wataru Yamanaka, Yokkaichi (JP); Masanobu Kasuga, Yokkaichi (JP); Ai Hirano, Yokkaichi (JP); Ryo Yamada, Toyota (JP)

(73) Assignee: Sumitomo Wiring Systems Ltd., Yokkaichi (JP)

( * ) Notice: Subject to any disclaimer, the term of this patent is extended or adjusted under 35 U.S.C. 154(b) by 63 days.

(21) Appl. No.: 17/345,058

(22) Filed: Jun. 11, 2021

(65) Prior Publication Data

US 2021/0305725 A1 Sep. 30, 2021

Related U.S. Application Data

(62) Division of application No. 16/802,622, filed on Feb. 27, 2020, now abandoned.

(30) Foreign Application Priority Data

Feb. 27, 2019 (JP) ..... JP2019-033580

(51) Int. Cl.
*H01R 9/05* (2006.01)
*H01R 43/048* (2006.01)

(52) U.S. Cl.
CPC ..... *H01R 9/0518* (2013.01); *H01R 43/048* (2013.01)

(58) Field of Classification Search
CPC ..... H01R 9/0518; H01R 43/048; H01R 13/6592–6593
USPC ..... 439/585
See application file for complete search history.

(56) References Cited

U.S. PATENT DOCUMENTS 5,380,224 A 1/1995 DiCicco
5,631,444 A 5/1997 Rook
5,795,188 A 8/1998 Harwath
5,975,949 A * 11/1999 Holliday ..... H01R 13/5205 439/585
6,425,782 B1 * 7/2002 Holland ..... H01R 9/0521 439/585

(Continued)

FOREIGN PATENT DOCUMENTS

JP 2010-232046 10/2010

*Primary Examiner* — Gary F Paumen
(74) *Attorney, Agent, or Firm* — Gerald E. Hespos; Michael J. Porco

(57) ABSTRACT

A sleeve (11) is a hollow cylindrical member provided in a shield terminal (10), and pressable by a wire barrel (18) by being arranged between an insulating portion (63) and a shield portion (62) of a shielded cable (60). A convex portion (36) shaped to bulge radially outward over an entire circumference is provided at an intermediate position of the sleeve (11) in an axial direction. The convex portion (36) is crushed and elongated by the wire barrel (18) of an outer conductor terminal (13). The insulating portion (63) can be prevented from being excessively compressed.

4 Claims, 6 Drawing Sheets

(56) References Cited

U.S. PATENT DOCUMENTS

| | | | | |
|---|---|---|---|---|
| 7,736,181 | B1 * | 6/2010 | Benevento | H01R 43/042 439/585 |
| 2003/0186583 | A1 * | 10/2003 | Yeh | H01R 9/0518 439/585 |
| 2004/0097130 | A1 * | 5/2004 | Holliday | H01R 9/0518 439/585 |
| 2004/0110418 | A1 * | 6/2004 | Holliday | H01R 9/0524 439/585 |
| 2005/0048836 | A1 * | 3/2005 | Holliday | H01R 9/0518 439/585 |
| 2012/0178289 | A1 * | 7/2012 | Holliday | H01R 24/40 439/585 |
| 2014/0045356 | A1 | 2/2014 | Natoli et al. | |
| 2014/0295703 | A1 | 10/2014 | Nagashima | |

* cited by examiner

SLEEVE AND SHIELD TERMINAL MANUFACTURING METHOD

CROSS-REFERENCE TO RELATED APPLICATIONS

This application is a divisional of U.S. patent application Ser. No. 16/802,622, filed on Feb. 27, 2020.

BACKGROUND

Field of the Invention

The invention relates to a sleeve and a shield terminal manufacturing method.

Related Art

A shield terminal having a shielding function is connected to an end part of a coaxial cable (shielded cable). Japanese Unexamined Patent Publication No. 2010-232046 discloses a sleeve provided in a shield terminal. The sleeve is inserted between a braided wire and an insulating portion inside the braided wire on an end part of the shield terminal.

The sleeve has a hollow cylindrical shape and is provided with projections at three positions spaced apart in a circumferential direction. The projections support the insulating portion at three points in the circumferential direction.

A barrel is crimped to the sleeve together with the braided wire. Japanese Unexamined Patent Publication No. 2010-232046 describes that an air layer is formed between the insulating portion and the sleeve by the respective projections to compensated for an impedance reduction due to a barrel crimping operation.

A projecting shape of each projection disclosed Japanese Unexamined Patent Publication No. 2010-232046, is maintained when and after the barrel is crimped. Thus, a tip of each projection may strongly bite into the insulating portion and the insulating portion may be partially crushed or cut when the barrel is crimped.

In contrast, sufficient flexural rigidity may not be ensured with a general-purpose sleeve having a hollow cylindrical shape and a constant diameter over the entire length. When the barrel is crimped, the sleeve itself may be crushed to compress the insulating portion excessively.

The invention was completed on the basis of the above situation and aims to provide a sleeve capable of preventing an insulating portion of a shielded cable from being compressed excessively and to provide a shield terminal with such a sleeve.

SUMMARY

A first aspect of the invention is directed to a hollow cylindrical sleeve arranged between an insulating portion and a shield portion of a shielded cable and pressable by a barrel. A convex portion is provided at an intermediate position of the sleeve in an axial direction and bulges radially outward over an entire circumference.

A second aspect of the invention is directed to a shield terminal manufacturing method that includes arranging a hollow cylindrical sleeve between an insulating portion and a shield of a shielded cable, pressing a barrel toward the sleeve so that the barrel crushes and elongates a convex portion that bulges radially out over an entire circumference at an intermediate position of the sleeve in an axial direction and thereby connecting an outer conductor terminal to the shielded cable.

According to the first and second aspects of the invention, the convex portion bulges radially out over the entire circumference and is provided at the intermediate position of the sleeve in the axial direction. Thus, the flexural rigidity (reaction force) of the sleeve can be enhanced. This makes the sleeve hard to crush during the pressing of the barrel, and the insulating portion will not be compressed excessively by the sleeve. Particularly, since the convex portion is provided over the entire circumference of the sleeve, a circumferentially uniform compression force can be applied to the insulating portion and the sleeve will not bite into a circumferential part of the insulating portion.

According to the second aspect of the invention, the convex portion is crushed and elongated by the barrel. Thus, the insulating portion will not be compressed excessively by the convex portion.

The sleeve may have a receiving base on a radially outer end part of the convex portion and extending along an axial part that is pressable by the barrel. According to this configuration, a clearance along the axial direction can be formed between the inner surface of the receiving base and the insulating portion. Thus, the insulating portion is prevented more reliably from being compressed excessively.

An end convex portion may bulge radially out on an end part in the axial direction and may extend over an entire circumference and a concave portion may be formed between the end convex portion and the intermediate convex portion in the axial direction. According to this configuration, a convex-concave shape is formed by the end concave portion. The end convex portion and the concave portion are provided continuously on an end of the sleeve in the axial direction. Thus, the flexural rigidity of the sleeve is enhanced further and the insulating portion is prevented more reliably from being compressed excessively.

The barrel for pressing the convex portion may be configured to contact the shield. Accordingly, flexural rigidity of the sleeve is enhanced while preventing the insulating portion from being compressed excessively.

DETAILED DESCRIPTION

One embodiment of the invention is described with reference to FIGS. 1 to 6. A sleeve 11 of this embodiment is provided in a shield terminal 10 having a shielding function, and is connected to an end part of a shielded cable 60.

<Shielded Cable 60>

Figure 3:
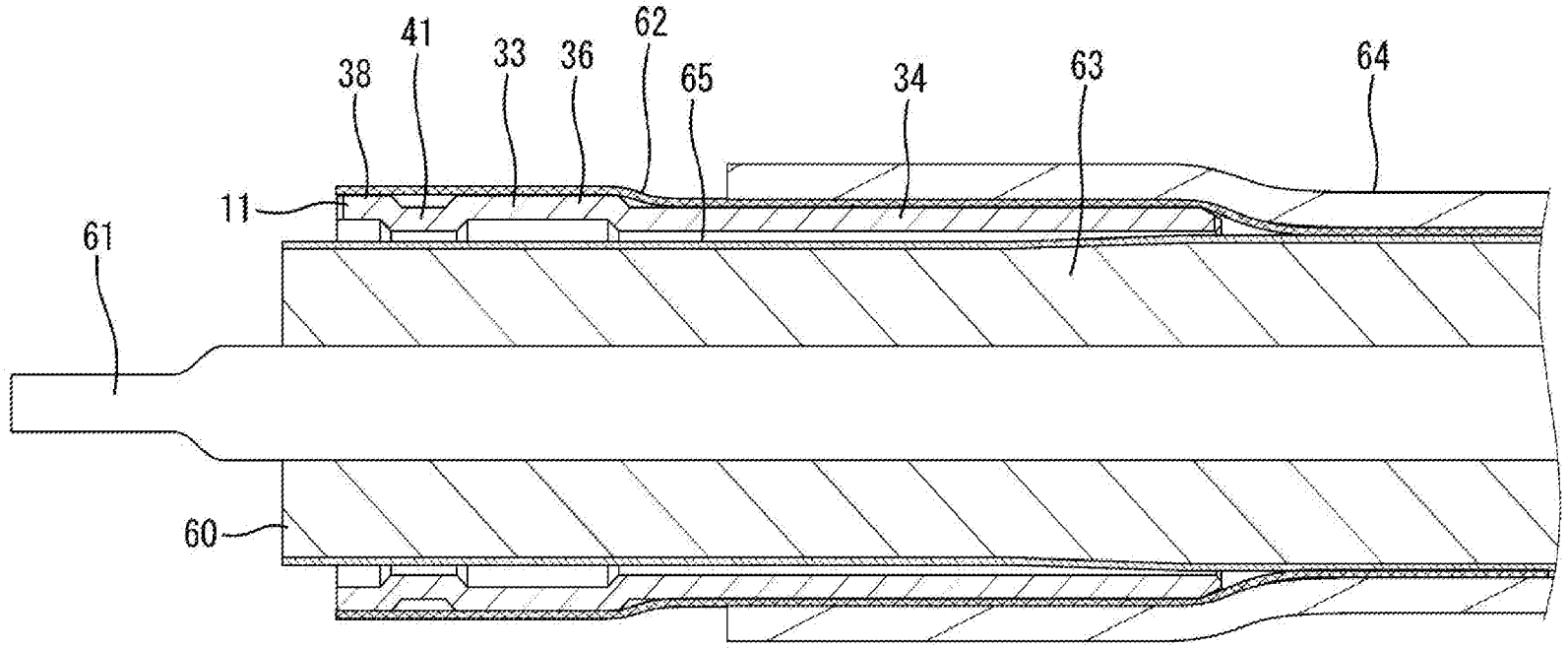
FIG. 3 is a section showing a state where the sleeve is arranged between an insulating portion and a shield portion on an end part of a shielded cable.
Figure 4:
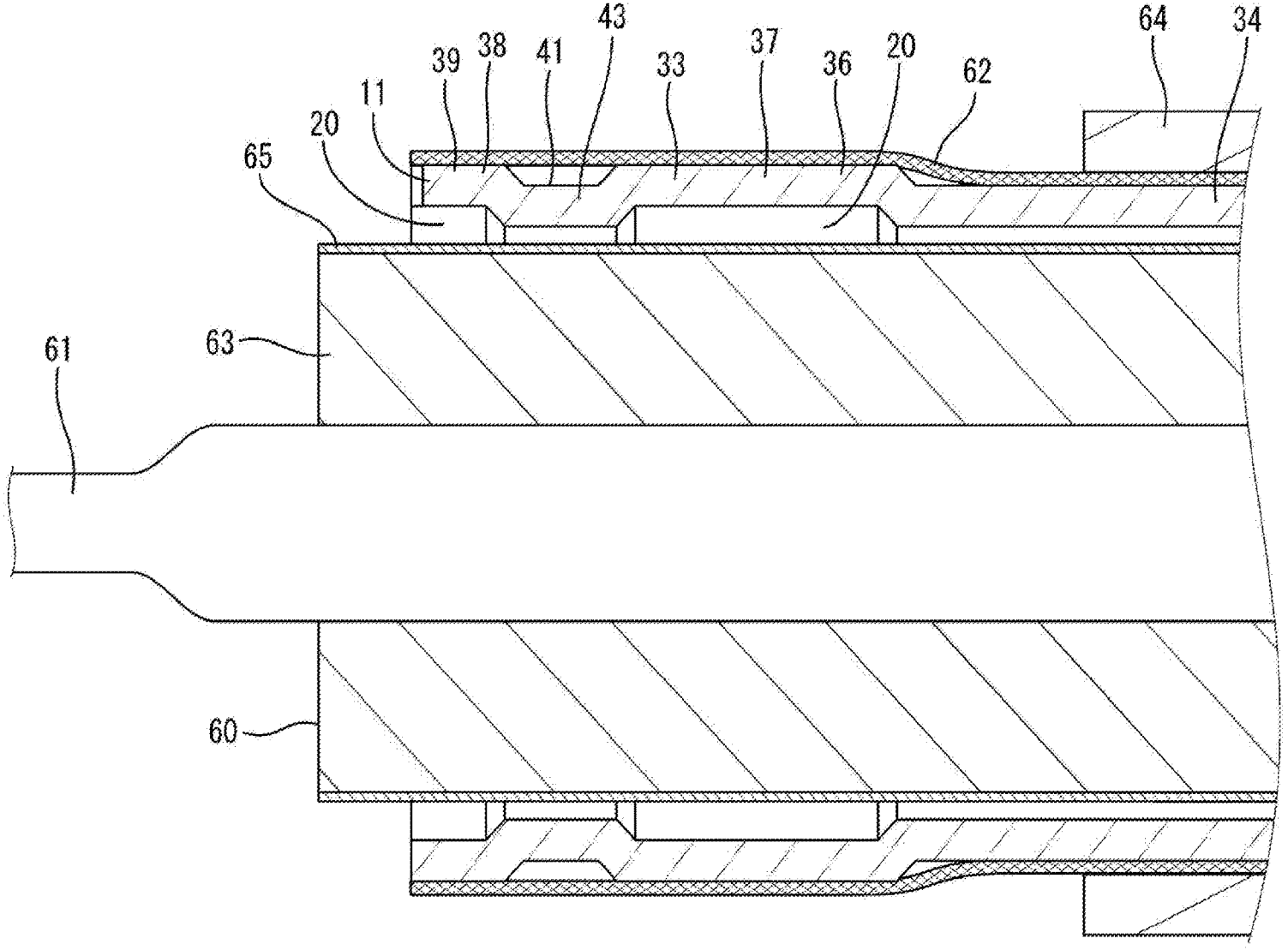
FIG. 4 is an enlarged view of an essential part of FIG. 3.

The shielded cable 60 is a coaxial cable and, as shown in FIGS. 3 and 4, includes a core 61 made of a conductor for transmitting a high-frequency signal, and a shield 62 made of a braided wire surrounds the core 61. An insulating portion 63 made of insulating resin covers the outer periphery of the core 61, and the shield 62 covers the outer periphery of the insulating portion 63. A sheath 64 made of insulating resin covers the outer periphery of the shield 62. In this embodiment, a layer of a metal foil 65, such as a copper foil, is provided between the insulating portion 63 and the shield 62. The layer of the metal foil 65 functions to adjust an impedance in a transmission path to a specified value.

The sheath 64 is removed in a predetermined range on the end part of the shielded cable 60 to expose an end part of the shield 62. Further, the shield 62, the insulating portion 63 and the metal foil 65 are removed in a predetermined range to expose an end part of the core 61.

<Shield Terminal 10>

Figure 6:
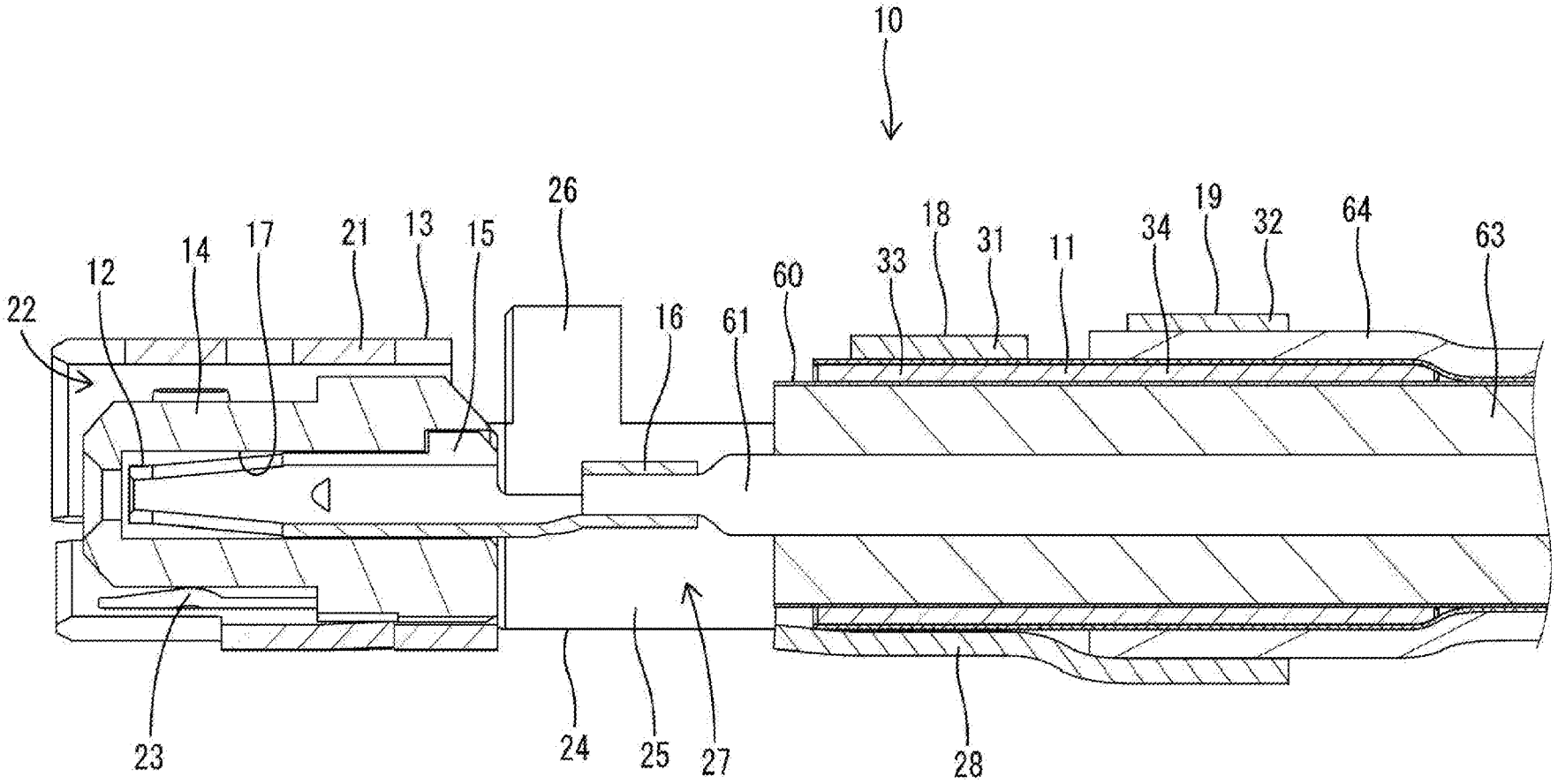
FIG. 6 is a section of the shield terminal connected to the end part of the shielded cable.

As shown in FIG. 6, the shield terminal 10 includes an inner conductor terminal 12, an outer conductor terminal 13 surrounding the inner conductor terminal 12 and a dielectric 14 interposed between the outer conductor terminal 13 and the inner conductor terminal 12 in addition to the sleeve 11. The sleeve 11, the inner conductor terminal 12 and the outer conductor terminal 13 are made of metal, and the dielectric 14 is made of resin.

The inner conductor terminal 12 is formed integrally, such as by bending a conductive metal plate and includes a mating connecting portion 15 and a wire-side connecting portion 16. The mating connecting portion 15 is in a front part on a shown left side and is connectable to an unillustrated mating inner conductor terminal. The wire-side connecting portion 16 is in a rear part on a shown right side and forms an open barrel to be crimped to the core 61. The mating connecting portion 15 has a tubular part elongated in the front-rear direction, and a tab of the mating inner conductor terminal is inserted into the mating connecting portion 15 for connection.

The dielectric 14 includes an accommodating portion 17 extending in the front-rear direction and open in a rear surface. The inner conductor terminal 12 is inserted into the accommodating portion 17 from behind. The inner conductor terminal 12 is incorporated into the dielectric 14 with the mating connecting portion 15 accommodated in the accommodating portion 17 and the wire-side connecting portion 16 projecting rearward from the rear surface of the dielectric 14.

Figure 5:
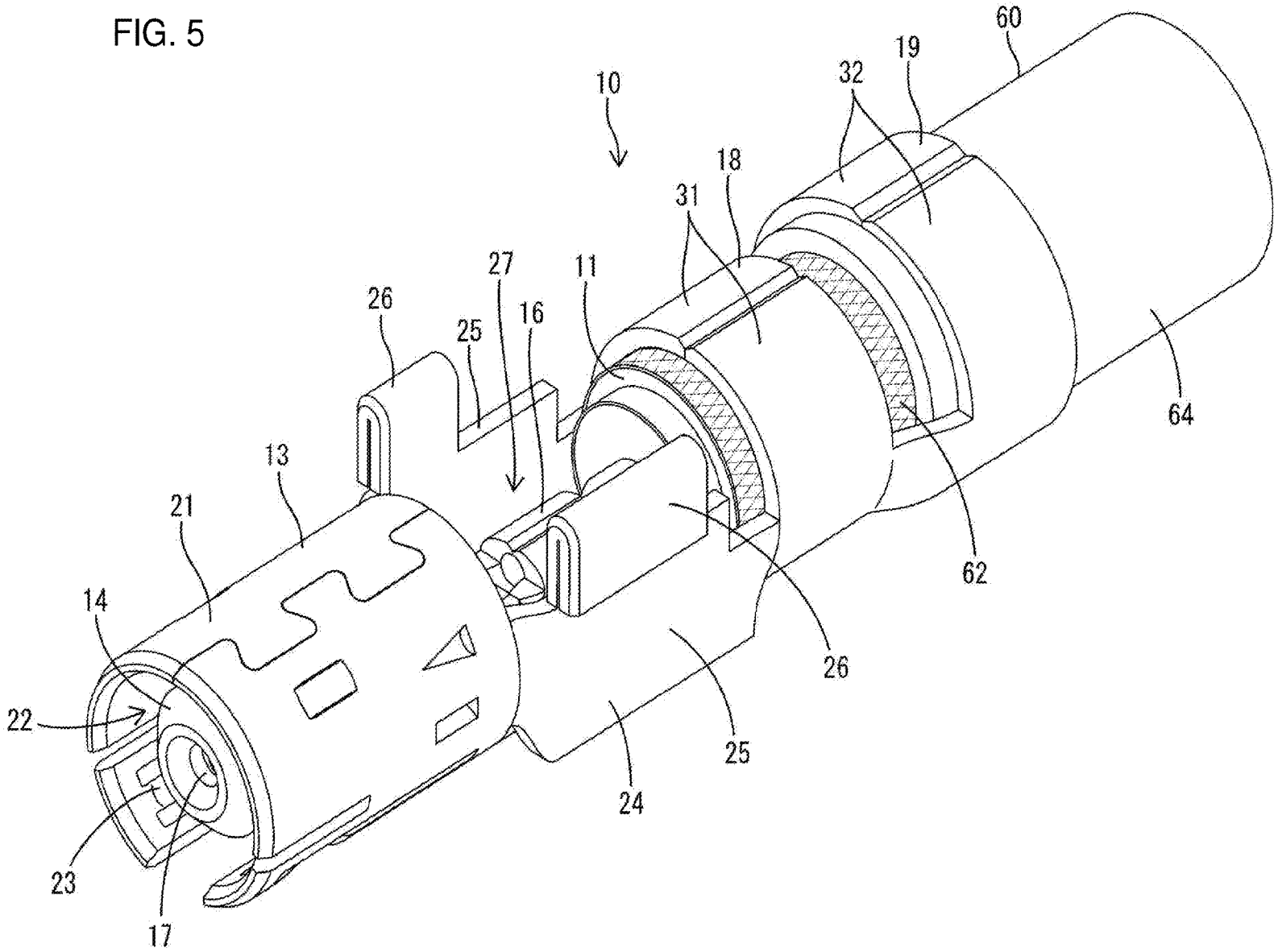
FIG. 5 is a perspective view of a shield terminal connected to the end part of the shielded cable.

The outer conductor terminal 13 is formed integrally, such as by bending a conductive metal plate and includes, as shown in FIG. 5, a hollow cylindrical fitting 21, a wire barrel 18 located behind the fitting 21, an insulation barrel 19 behind the wire barrel 18 and a coupling 24 coupling the fitting 21 and the wire barrel 18. A barrel is constituted by the wire barrel 18 and the insulation barrel 19.

The fitting portion 21 accommodates the dielectric 14 inside. A forwardly open fitting space 22 is formed between the inner surface of the fitting portion 21 and the dielectric 14. An unillustrated mating outer conductor terminal is fit into the fitting space 22. The mating outer conductor terminal conductively contacts a connecting portion 23 provided in the fitting portion 21 inside the fitting space 22.

The coupling 24 includes left and right side walls 25. The front ends of the respective side walls 25 are coupled integrally to the fitting 21 and the rear ends thereof are coupled integrally to the wire barrel 18. Left and right projections 26 project on the upper ends of the respective side walls 25. Although not described in detail, when the shield terminal 10 is inserted into an unillustrated connector housing, the projections 26 guide the insertion of the shield terminal 10 and restrict the escape of the shield terminal 10 from the connector housing.

A space 27 vertically penetrates a space 27 between the side walls 25 of the outer conductor terminal 13, as shown in FIG. 6. The wire-side connecting portion 16 of the inner conductor terminal 12 is arranged in the space 27 and can be crimped to the core 61 by tools (crimper, anvil) entering the space 27 from both upper and lower sides.

The wire barrel 18 is crimped and connected to the shield 62 of the shielded cable 60. The wire barrel 18 is in the form of an open barrel and includes two wire barrel pieces 31 rising from both left and right sides of a bottom portion 28. Each wire barrel piece 31 is wound on the outer periphery of the shield 62.

The insulation barrel 19 is one size larger than the wire barrel 18 and crimped and is connected to the sheath 64 of the shielded cable 60. The insulation barrel 19 is an open barrel and includes two insulation barrel pieces 32 rising from both left and right sides of the bottom portion 28. Each insulation barrel piece 32 is wound on the outer periphery of the sheath 64.

<Sleeve 11>

The sleeve 11 is made of metal, has a hollow cylindrical shape and is inserted between the metal foil 65 (on the side of the insulating portion 63) and the 62, as shown in FIGS. 3 and 4. The sleeve 11 is longer than the barrel (wire barrel 18 and insulation barrel 19) in the front-rear direction. As shown in FIG. 6, the sleeve 11 has a front pressed region 33 to be pressed by the wire barrel 18 in a front part and a rear pressed region 34 to be pressed by the insulation barrel 19 in a rear part.

Figure 1:
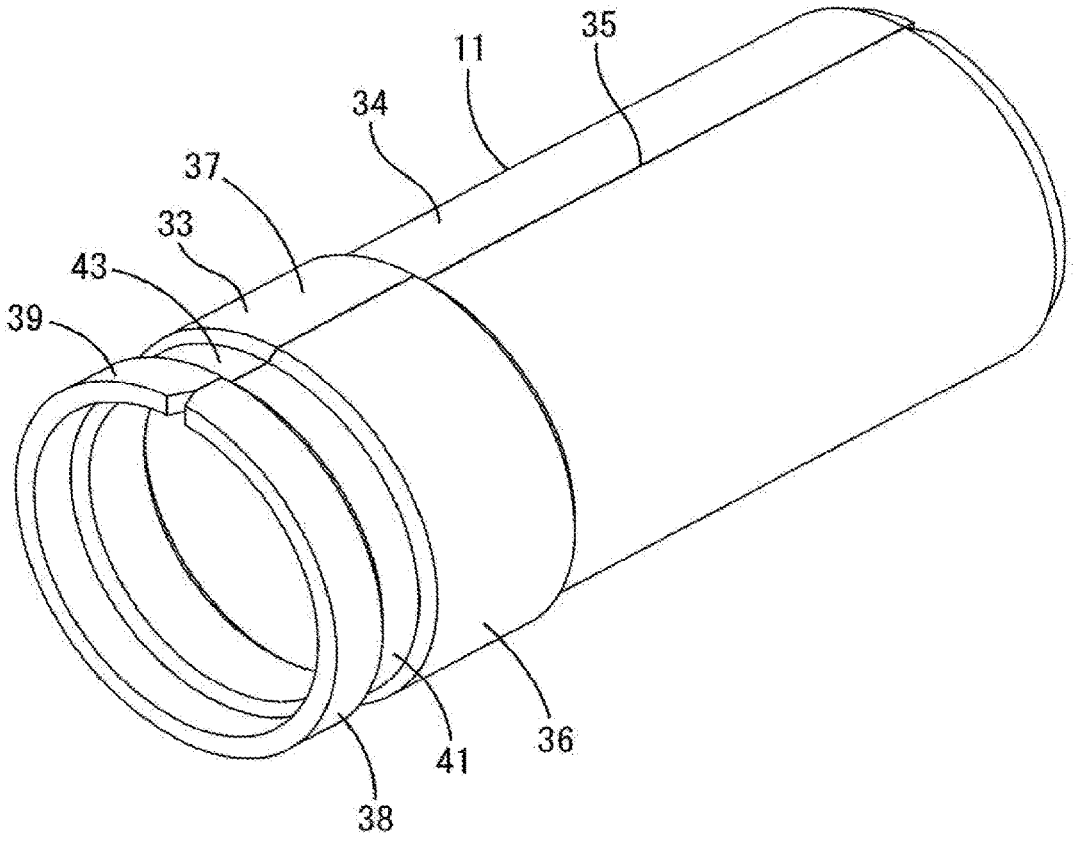
FIG. 1 is a perspective view of a sleeve of one embodiment of the present invention.
Figure 2:
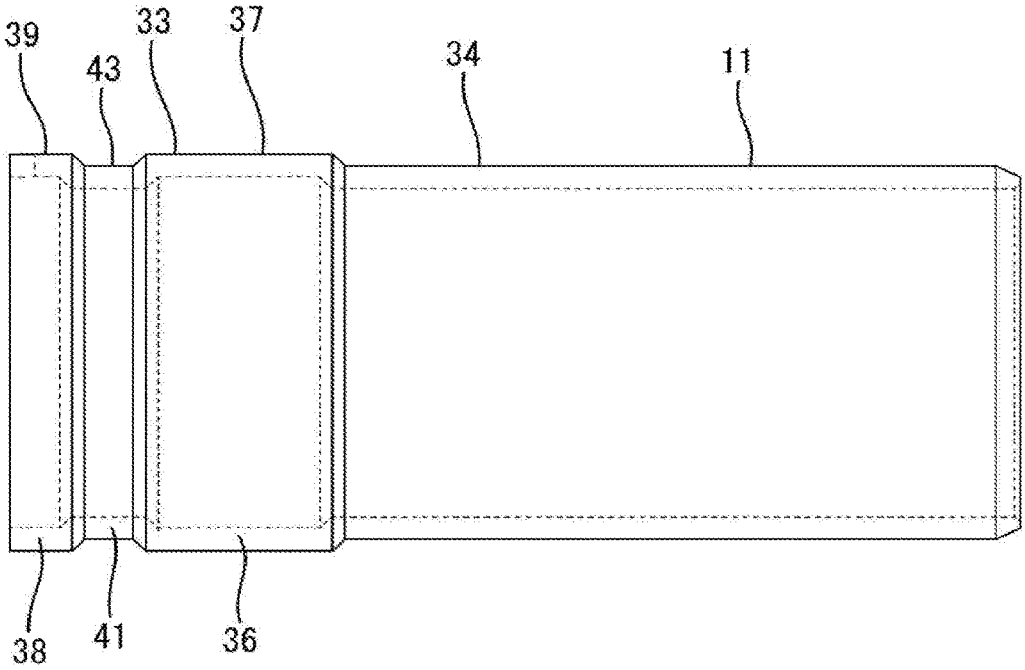
FIG. 2 is a side view of the sleeve.

The sleeve 11 is formed into a hollow cylindrical shape by rolling a flat plate having a substantially rectangular shape in a developed state. As shown in FIG. 1, butting edges 35 on both circumferential ends are provided along the front-rear direction (axial direction) in the sleeve 11. The sleeve 11 can maintain the hollow cylindrical shape with the butting edges 35 butted against each other.

The sleeve 11 includes a convex portion 36 that bulges radially out over the entire circumference in the front pressed region 33 at an intermediate position in the front-rear direction. As shown in FIG. 4, the convex portion 36 has a flat shape in a side view and includes a receiving base 37 along the front-rear direction on a radially projecting end part. The receiving base 37 has inner and outer diameters constant in the front-rear direction and larger than those of parts adjacent in the front-rear direction. The receiving base 37 receives a pressing force (compression force) of the wire barrel 18 and faces the wire barrel 18. The receiving base 37 is shorter than the wire barrel 18 in the front-rear direction.

The sleeve 11 includes an end convex portion 38 shaped to bulge radially outward over the entire circumference in a front part forward of the front pressed region 33. The end convex portion 38 includes an outer peripheral portion 39 along the front-rear direction on a projecting end part. The outer peripheral portion 39 has substantially the same inner and outer diameters as those of the receiving base 37. The outer peripheral portion 39 has a length shorter than that of the receiving base 37 in the front-rear direction and is located in the front part of the sleeve 11. The butting edges 35 are open toward the front end of the sleeve 11 in the outer peripheral portion 39.

The sleeve 11 is formed with a concave portion 41 between the end convex portion 38 and the convex portion 36 in a front part of the front pressed region 33. As shown in FIG. 4, front and rear end parts of the concave portion 41 are defined by a rear end part of the end-side convex portion 38 and a front part of the convex portion 36, thereby being tapered to have a smaller diameter toward a radially inner side. A back portion 43 of the concave portion 41 is arranged along the front-rear direction and has the same inner and outer diameters as those of parts of the sleeve 11 except the convex portion 36 and the end convex portion 38. Note that the convex portion 36 and the end-side convex portion 38 are formed together with the concave portion 41 by press-working the flat plate having the substantially rectangular shape in the developed state prior to the bending of the sleeve 11.

The sleeve 11 is inserted between the shield 62 and the metal foil 65 (on the side of the insulating portion 63) in the shielded cable 60 from the front. As shown in FIG. 3, a front part of the sleeve 11 including the front pressed region 33 is arranged forward of the sheath 64, and a rear part including the rear pressed region 34 is arranged while being inserted inside the sheath 64. As shown in FIG. 4, clearances 20 at a given interval in the front-rear direction are formed between the receiving base 37 of the convex portion 36 and the metal foil 65 and between the outer peripheral portion 39 of the end convex portion 38 and the metal foil 65.

The shielded cable 60 is on the barrel of the outer conductor terminal 13 with the sleeve 11 mounted. The wire barrel 18 is arranged to face the front pressed region 33 of the sleeve 11, and the insulation barrel 19 is arranged to face the rear pressed region 34 of the sleeve 11. In that state, unillustrated tools (crimper, anvil) are brought into contact with the wire barrel 18 and the insulation barrel 19 to apply a radially inward pressing force. The front pressed region 33 of the sleeve 11 is pressed by the wire barrel 18 via the shield 62, and the rear pressed region 34 of the sleeve 11 is pressed by the insulation barrel 19 via the shield 62 and the sheath 64.

The convex portion 36 is crushed together with the concave portion 41 and the end convex portion 38 and almost elongated forward when the pressing force of the wire barrel 18 exceeds a predetermined value. In this way, the clearances 20 formed between the receiving base portion 37 of the convex portion 36 and the metal foil 65 and between the outer peripheral portion 39 of the end-side convex portion 38 and the metal foil 65 are substantially eliminated (see FIG. 6).

The front pressed region 33 of the sleeve 11 is enhanced in flexural rigidity by the continuous convex-concave shape formed by the convex portion 36, the concave portion 41 and the end convex portion 38, and is structured to be harder to crush than the rear pressed region 34. Thus, the front pressed region 33 of the sleeve 11 is not crushed significantly further even if the convex portion 36 are crushed, and can prevent the insulating portion 63 from being excessively compressed by being pressed by the sleeve 11.

The wire barrel 18 is crimped and connected to the shield 62 while being supported on the sleeve 11. Similarly, the insulation barrel 19 is crimped and connected to the sheath 64 while being supported on the sleeve 11. In this embodiment, the wire barrel 18, the insulation barrel 19 and the wire-side connecting portion 16 can be crimped simultaneously. In this way, the shield terminal 10 is connected to the end part of the shielded cable 60, as shown in FIG. 6.

As described above, the convex portion 36 shaped to bulge radially outward over the entire circumference is provided in the front pressed region 33 at the intermediate position of the sleeve 11 in the front-rear direction according to this embodiment. Thus, the flexural rigidity (reaction force) of the sleeve 11 can be enhanced and the insulating portion 63 can be prevented from being excessively compressed by the sleeve 11. Particularly, since the convex portion 36 is provided over the entire circumference of the sleeve 11, a circumferentially uniform compression force can be applied to the insulating portion 63. In addition, since the convex portion 36 is crushed and elongated by the wire barrel 18, the insulating portion 63 can be satisfactorily prevented from being excessively compressed by the convex portion 36.

Further, since the receiving base 37 along the front-rear direction is provided on the projecting end of the convex portion 36, the clearance 20 along the axial direction can be formed between the inner surface of the receiving base 37 and the insulating portion 63 before the wire barrel 18 is pressed, and the insulating portion 63 can be prevented more reliably from being excessively compressed.

Furthermore, since the end-side convex portion 38, the concave portion 41 and the convex portion 36 are successively provided one after another from the front end part in the sleeve 11, the front pressed region 33 is structured to be even harder to crush and the insulating portion 63 can be prevented even more reliably from being excessively compressed.

The invention is not limited to the above described and illustrated embodiment. For example, the following modes also are included in the scope of the invention.

The convex portion, the end-side convex portion and the concave portion may be formed, such as by swaging after the sleeve is bent.

The butting edges of the sleeve may be integrally joined by a joining means such as welding or adhesive. Further, the sleeve may be processed into an endless hollow cylindrical shape in the first place.

Plurality convex portions may be provided at intermediate positions of the sleeve in the front-rear direction.

The sleeve may be provided with a convex portion shaped to bulge radially outward over the entire circumference in a part pressable by the insulation barrel.

The sleeve may be structured not to be pressed by the insulation barrel. Further, the insulation barrel can be omitted from the barrel portion.

The end-side convex portion can be omitted from the sleeve.

LIST OF REFERENCE SIGNS

10 shield terminal
11 sleeve
13 outer conductor terminal
18 wire barrel
36 convex portion
37 receiving base
38 end convex portion
41 concave portion
60 shielded cable
62 shield
63 insulating portion

What is claimed is:

1. A shield terminal manufacturing method, comprising:

providing a shielded cable (60) having a core (61) made of a conductor, an insulating portion (63) covering the core (61), a shield (62) covering the insulating portion (63) and a sheath (64) covering the shield (62);

removing an end region of the sheath (64) to expose an end part of the shield (62);

arranging a hollow cylindrical sleeve (11) inward of the shield (62), the sleeve (11) having an intermediate convex portion (36) that bulges radially outward over an entire circumference at an intermediate position that is spaced from opposite front and rear longitudinal ends of the sleeve (11) in an axial direction;

arranging a barrel (18) of an outer conductor terminal (13) over the exposed part of the shield (62) so that a part of the barrel (18) is opposed to the intermediate convex portion (36) of the sleeve (11);

pressing the barrel (18) toward the shield (62) and the sleeve (11) so that the barrel (18) crushes and elongates the intermediate convex portion (36) of the sleeve (11).

2. The shield terminal manufacturing method of claim 1, wherein the shielded cable (60) further includes a metal foil (65) between the shield (62) and the insulating portion (63), the step of arranging the sleeve (11) inward of the shield (62) includes arranging the sleeve (11) between the shield (63) and the metal foil (65), and the step of pressing of the barrel (18) toward the shield (62) achieves conductive contact between the sleeve (18) and the metal foil (65).

3. The shield terminal manufacturing method of claim 2, wherein the sleeve (11) includes an end convex portion (38) that bulges radially out over the entire circumference of the sleeve (11) at a position adjacent the front longitudinal end of the sleeve (11), and a concave portion (41) formed between the intermediate convex portion (36) and the end convex portion (38) of the sleeve (11).

4. The shield terminal manufacturing method of claim 3, wherein the step of arranging the sleeve (11) inward of the shield (62) leaves circumferential spaces between the metal foil (65) and inner surfaces of both the intermediate convex portion (36) and the end convex portion (38), and the step of pressing the barrel (18) toward the shield (62) crushes both the end convex portion (38) and the intermediate convex portion (36) sufficiently to bring the inner surfaces of the end convex portion (38) and the intermediate convex portion (36) into conductive contact with the shield (62).

* * * * *